United States Patent [19]

Guzzetta

[11] Patent Number: 4,756,295

[45] Date of Patent: Jul. 12, 1988

[54] TOGGLE LINK POWER CELL BOW

[76] Inventor: Matthew P. Guzzetta, 10424 Loma Rancho Dr., Spring Valley, Calif. 92077

[21] Appl. No.: 867,085

[22] Filed: May 27, 1986

[51] Int. Cl.[4] ..... F41B 5/00; F41B 7/00; F41D 10/00

[52] U.S. Cl. ..... 124/16; 124/24 R; 124/87; 124/88; 124/41 A; 124/DIG. 1; 33/265

[58] Field of Search ..... 124/16, 26, 25, 23 R, 124/24 R, 41 A, 87, 88, DIG. 1; 33/265; 74/89.14

[56] References Cited

U.S. PATENT DOCUMENTS

| | | | |
|---|---|---|---|
| 1,090,259 | 3/1914 | Watson | 74/89.14 |
| 2,611,355 | 9/1952 | Ashwood | 124/26 |
| 2,844,136 | 7/1958 | Folberth | 124/23 R |
| 3,521,362 | 7/1970 | Duplechin | 124/23 R |
| 3,718,979 | 3/1973 | Allen | 33/265 |
| 3,942,506 | 3/1976 | Izuta | 124/24 R |
| 3,981,290 | 9/1976 | Islas | 124/24 R |
| 4,041,927 | 8/1977 | Van House | 124/24 R |
| 4,524,750 | 6/1985 | Darlington | 124/23 R |

*Primary Examiner*—Richard C. Pinkham
*Assistant Examiner*—Benjamin Layno
*Attorney, Agent, or Firm*—Frank D. Gilliam

[57] ABSTRACT

A compound bow using a toggle link assembly to provide improved arrow speed, greater accuracy and improved ease of tuning and use. The bow basically includes first and second spaced bow limbs having a bowstring extending between their outer ends and having their other ends attached through power links to the opposite ends of a main riser. An adjustable connection between the limbs causes them to move in unison. A power canister is secured to the riser adjacent to one of the limb attachments. A toggle link assembly is connected between a power storage compression spring in the canister, and a link on the adjacent limb. As the bowstring is drawn with an arrow in the conventional manner, the toggle link assembly causes energy to be stored in the canister, such as by compressing the spring. When the bowstring is released, the stored energy imparts acceleration to the arrow through the toggle link assembly, limbs and bowstring. Details of a preferred toggle link assembly, an adjustable inter-limb connector, adjustable arrow rest and adjustable sight are also disclosed.

32 Claims, 5 Drawing Sheets

TOGGLE LINK POWER CELL BOW

BACKGROUND OF THE INVENTION

This invention relates in general to compound bows and, more specifically, to an improved compound bow using a toggle link assembly and other features to improve accuracy, arrow acceleration and ease of use.

Arrow firing bows have been greatly improved since the ancient shortbows made of solid wood, or wood, horn and sinew. The shortbow was most often the arm of mounted men, since it could conveniently be discharged from horseback and when not in use could be slung over the back of the soldier with the string across his breast. The longbow, having a length about the same as the height of the man who carried it, in the hands of a foot soldier, was a much more powerful weapon than its predecessor, the shortbow.

The longbow was a popular weapon, primarily with the English from around 1300 until superseded by handguns in the early 1500's. In many European armies, cross-bows, having thick steel bows bent by sturdy windlasses, were used from their invention around 1370 until replaced by firearms in the 1500's. Since then, bows of various types have continued to be used by sportsmen and hobbyists for hunting and target shooting.

In recent years, a number of major improvements have been made in materials for bows and arrows and in the design of bows, culminating in the complex modern compound bows and bow sights.

While modern bows are greatly improved, they are less than optimum in several areas. They are very complex and require considerable skill to make and use, with multiple cords and pulleys and complex adjustments. Since the energy stored in the bow and the resulting arrow speed depends on the length of draw, shot-to-shot accuracy depends greatly on the skill of the archer in consistently drawing to the identical point and holding the draw against high draw weights while sighting.

Modern compound bows, with all their complexity and adjustments, are still not easily adjustable by the ordinary archer for draw length, draw weight, hold weight, tiller and arrow guiding. It is difficult to change from a light, practice, draw weight to a high, hunting, draw weight without changing bow balance, weight distribution and feel.

Thus, there is a continuing need for improvements in compound bows to overcome the above-noted problems and to permit manufacture, adjustment and use by less skilled persons.

SUMMARY OF THE INVENTION

The above described problems, and others, are overcome by my toggle link compound bow which basically comprises an elongated main riser having at the ends a pair of limbs, the free ends of the limbs being connected by a bowstring, an adjustable connecting rod between said limbs causing them to move in unison and a toggle link assembly between one limb and a power storing canister means so that as the bowstring is drawn with an arrow in place, power is stored in the canister means and released when the bowstring is released to accelerate the arrow.

In preferred embodiments of this basic bow, I provide improved power links between the limbs and the connecting means, bowstring-to-limb connections, an adjustable arrow rest, an adjustable sight, an optimum adjustable power storage means and a variable toggle link assembly between limbs and power storage means to vary bow draw and hold weights.

BRIEF DESCRIPTION OF THE DRAWING

Details of preferred embodiments of my bow and of the various components mentioned above are provided in the drawings, wherein.

DETAILED DESCRIPTION OF THE INVENTION

Figure 1:
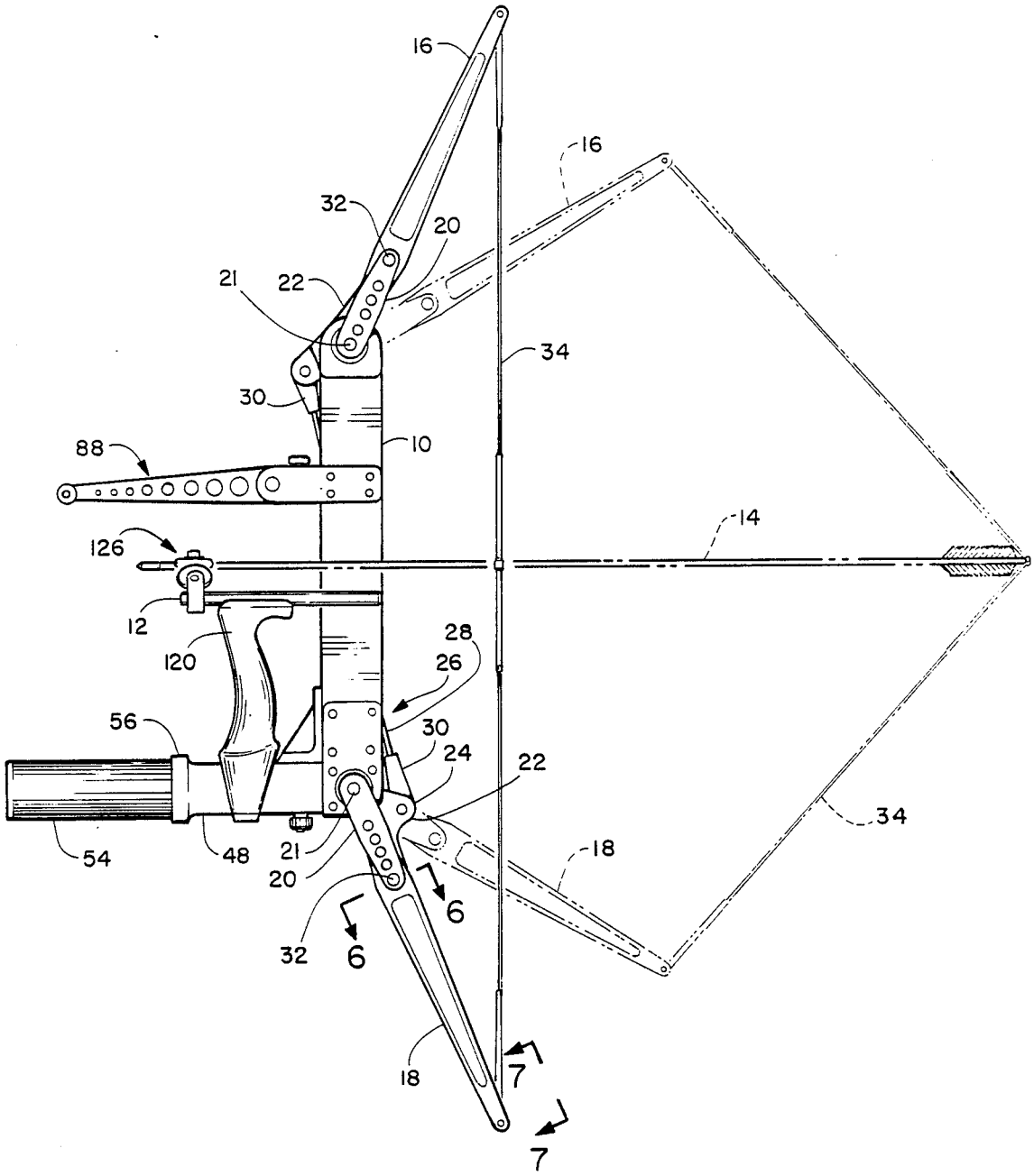
FIG. 1 is a left-side elevation view of my bow.
Figure 2:
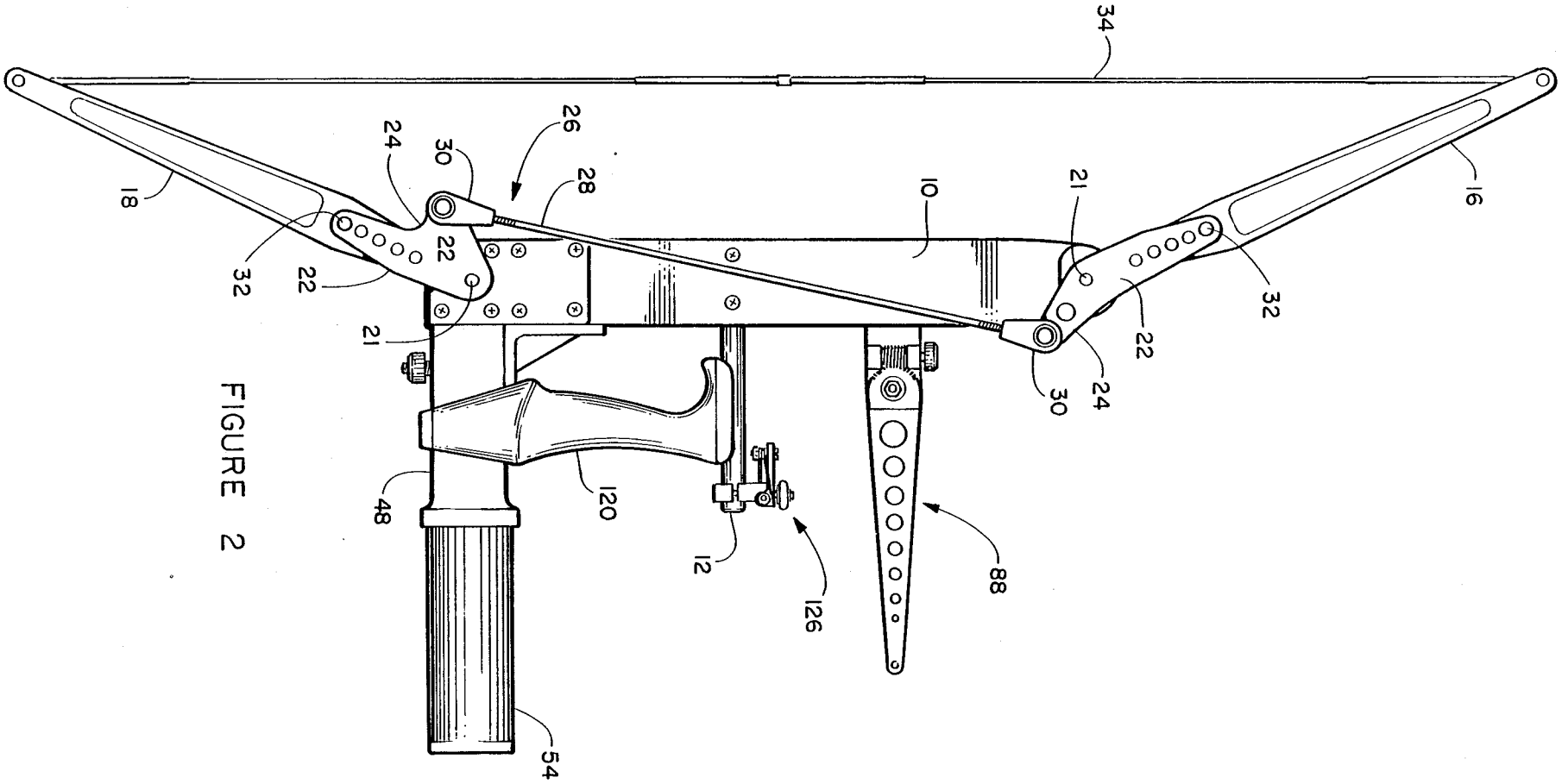
FIG. 2 is a right side elevation view of the bow of FIG. 1.

Referring now to FIGS. 1 and 2, there is seen my toggle link, power cell compound bow in side elevation. Main riser 10 carries the other bow components. Riser 10 is bent slightly to one side (to the right in the embodiment shown) to clear the arrow rest rod 12 described in detail below, and arrow 14, shown in phantom. Riser 10 may either be a single sturdy strap bent to either side or two straps secured together at top and bottom and bowed apart at the center. Of these arrangements, the bend to the right is preferred for right-handed archers. Each of first or upper limb 16 and second or lower limb 18 is pivotably attached to the riser 10 by a pair of power links, a first power link 20 which serves simply to connect a limb to riser 10 through pivot point at bolt 21 and a second power link 22 (of slightly different shape) which also has an extended end 24 which is pivotably connected to connecting rod assembly 26. Limbs 16 and 18 may be formed from any suitable material such as aluminum, fiber reinforced composites, wood or the like.

As can be seen in FIGS. 1 and 2, one extended end 24 extends forwardly and the other rearwardly of each power link 22 so that the limbs move in unison when moved from the rest position shown in solid lines to the fully drawn position shown in broken lines in FIG. 1. In order to permit "tiller" (the angular relationship between the arrow and the string) to be adjusted, connecting rod assembly 26 includes a central rod 28 which is threaded into end fittings 30 with a right hand thread at one end and a left hand thread at the other so that as rod 28 is rotated, the length of the assembly 26 changes in the manner of a conventional turnbuckle.

Figure 6:
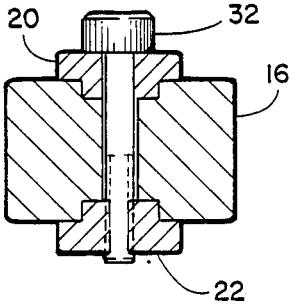
FIG. 6 is a detail sectional view taken on line 6—6 in FIG. 1.

While limbs 16 and 18 could be formed integrally with power links 20 and 22, if desired, I prefer the separate link arrangement described above, with the links bolted by bolts 32 to the limbs in a strong, tongue-and groove, arrangement as shown in detail in FIG. 6, so that limbs 16 and 18 can be easily replaced with longer or shorter limbs to change bow characteristics.

Figure 7:
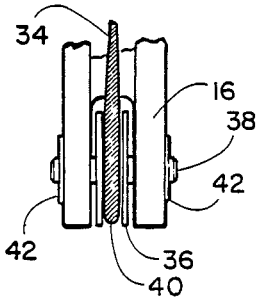
FIG. 7 is a detail sectional view taken on line 7—7 in FIG. 1.

Bowstring 34 is connected to the free ends of limbs 16 and 18 through two small pulleys 36 (as best seen in FIG. 7) mounted within slots in the ends of the limbs by axles 38. Loops 40 in the ends of string 34 pass over the pulleys 36. Spring clips 42 removably hold axle 38 in place. To change bowstrings, the clips 42 are simply removed, axle 38 is pushed out and the pulley 36 removed, the loop is positioned around the pulley and the pulley is replaced. This pulley arrangement is preferred for low friction as bowstring 34 is moved between the position shown in solid lines and the position shown in broken lines in FIG. 1. While they tend to have greater friction, if desired spherical rod ends could be provided on the ends of limbs 16 and 18 over which the bowstring loops 40 could be positioned in place of the described pulley means, or simple grooves in the ends of limbs 16 and 18 could receive the end loops of bowstring 34.

Figure 3:
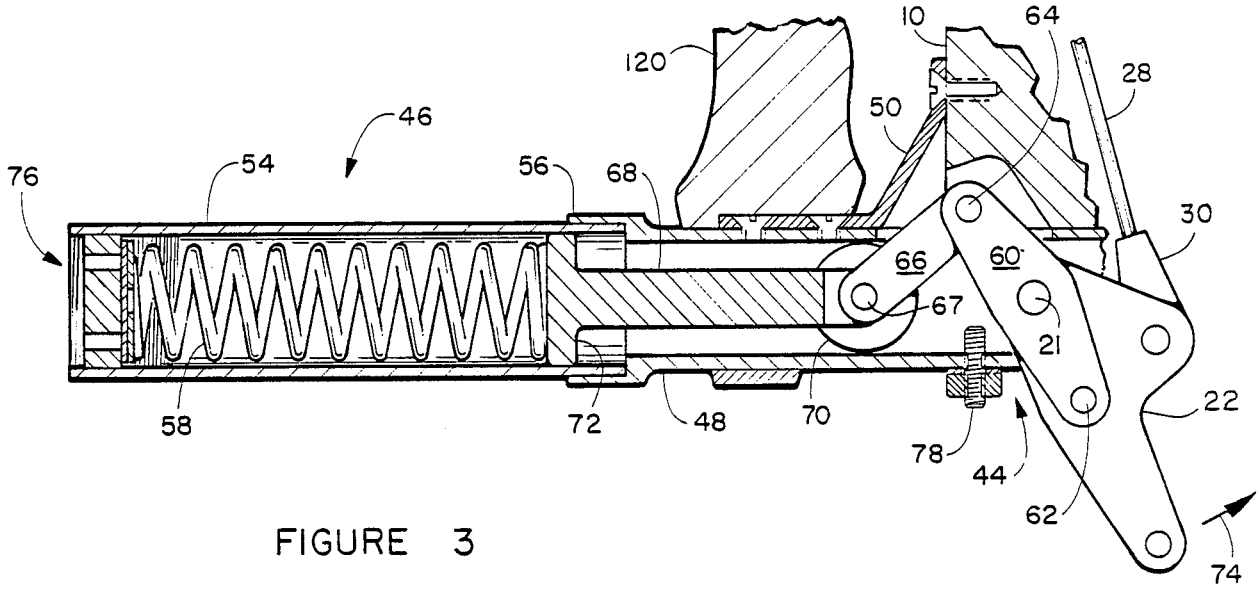
FIG. 3 is a detail elevation view, partly cut-away of my toggle link assembly and power storage means in the static, at rest, position.
Figure 4:
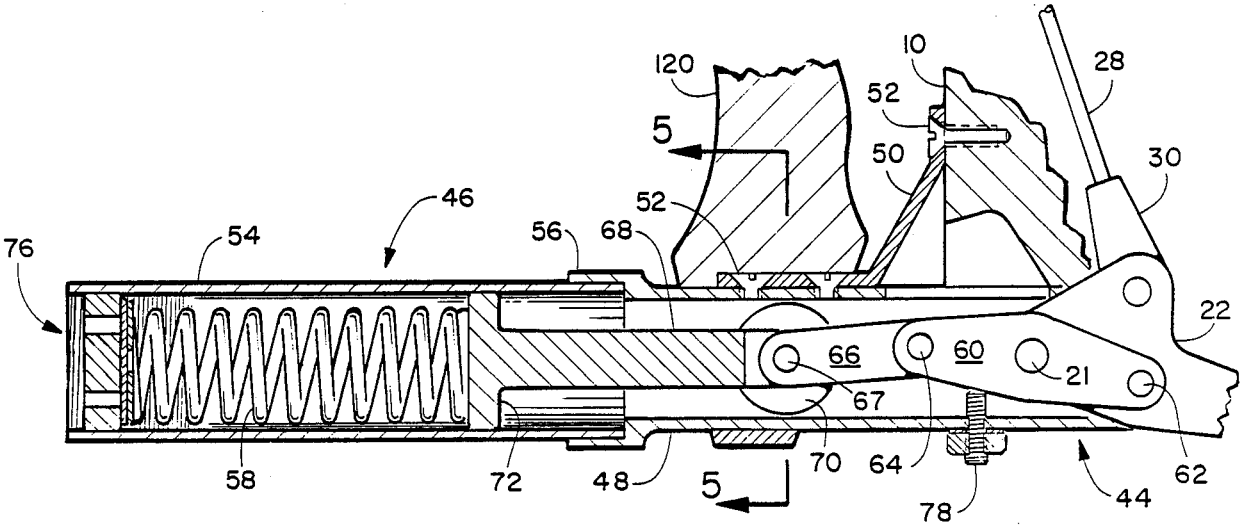
FIG. 4 is a detail elevation view of FIG. 3 with the bow at full draw.
Figure 5:
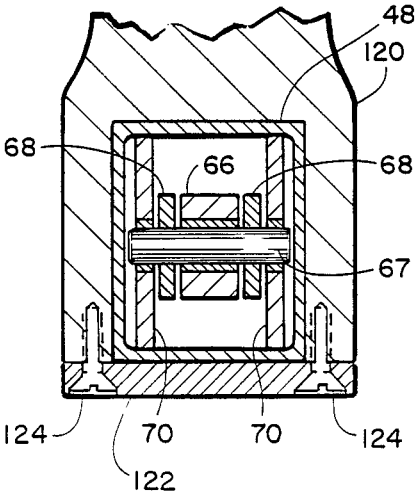
FIG. 5 is a detail sectional view taken on line 5—5 in FIG. 4.

Details of my toggle link assembly 44 and associated power canister assembly 46 are provided in FIGS. 3, 4 and 5. Toggle link assembly 44 is positioned within a housing 48 which has a generally rectangular tubular configuration, as best seen in FIG. 4. Housing 48 is secured to riser 10 by any suitable brackets and screws such as those schematically indicated at 50 and 52, respectively. A cylindrical, tubular power canister 54 is threaded into a cap 56 on the end of housing 48. In the preferred embodiment shown, canister 54 contains a compression coil spring 58 capable of storing power when compressed. If desired, an air spring, leaf spring or other energy storage device could be used in place of spring 58. Housing 48, cap 56 and canister 54 are partially cut-away to reveal the internal components in FIGS. 2 and 3 and the near power link 20 (as seen in FIG. 1) is removed to reveal the other links.

Toggle link assembly 44 comprises a first toggle link 60 which is securely bolted to lower second power link 22 by bolts 21 and 62. As discussed above, the limb assemblies pivot on riser 10 about bolts 21. The second end of first toggle link 60 is pivotably connected at pivot 64 to second toggle link 66. First toggle link 60 can be removed and replaced with links of different lengths or angles about center bolt 21 to change the leverage between the limbs and spring 58 resulting in a change in the bow draw distance, arrow accelaration and smoothness of bow draw as further discussed below.

The second end of second toggle link 66 is pivotably connected at a pivot 67 to the bifurcated end of piston rod 68 and to two wheels 70, as best seen FIG. 5. In FIGS. 3 and 4 the near portion of piston rod end 68 is cut-away to show pivot 67 and the end of second toggle link 66 more clearly. The wheels 70 greatly reduce friction from sideloading on the piston rod 68 and piston 72 induced by second toggle link 66.

As the bow is drawn, moving string 34 to the position shown in broken linesin FIG. 1, limbs 16 and 18 are moved to the positions shown in broken lines in FIG. 1. Second power link 22 is moved from the position shown shown in FIG. 4. The straightening of the toggle assembly 44 causes piston 72 to compress spring 58 against end plug assembly 76 which is threaded into the open end of canister 54.

A set-screw 78 limits the draw of the bow and the degree to which toggle assembly 44 can be straightened. Set-screw 78 adjusts the "hold weight" which is the power needed to hold the bow at full draw. In a typical compound bow of the prior art, the hold weight is between 30 and 50% less than the peak draw weight. Set-screw 78 allows infinite adjustment of the hold weight up to 100% less than the draw weight, when the toggle assembly is fully straight and "locked". No prior art compound bow can do this. Also, set-screw 78 provides a draw stop which guarantees the same power to the arrow with each shot, providing accuracy not attainable with prior bows.

Figure 8:
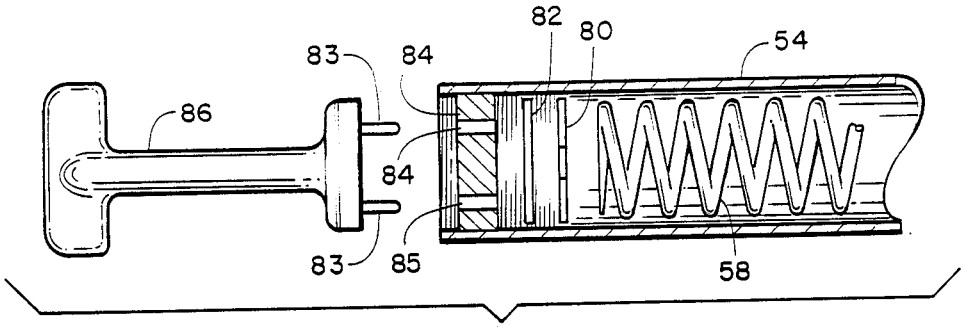
FIG. 8 is a partially cut-away detail exploded view of the adjustable closure means of the power storage means as seen in FIGS. 3 and 4.

Details of plug assembly 76 are provided in FIG. 8 which shows the components in a spaced arrangement along canister 54 for clarity. A metal washer 80, and a low friction (typically plastic or greased metal) thrust bearing disk 82 are placed in the end of canister 54 against spring 58, then threaded plug 84 is threaded in by a spanner 86. The washer 80 and thrust bearing disk 82 allow easier turning of the adjusting plug with high preloads on spring 58. The position of plug assembly 76 along canister 54 determines the preload on spring 58 and the total power "draw weight" of the bow. Typically, plug 84 can be rotated by spanner 86 having pins 83 which correspond to holes 85 in plug 84.

Figure 9:
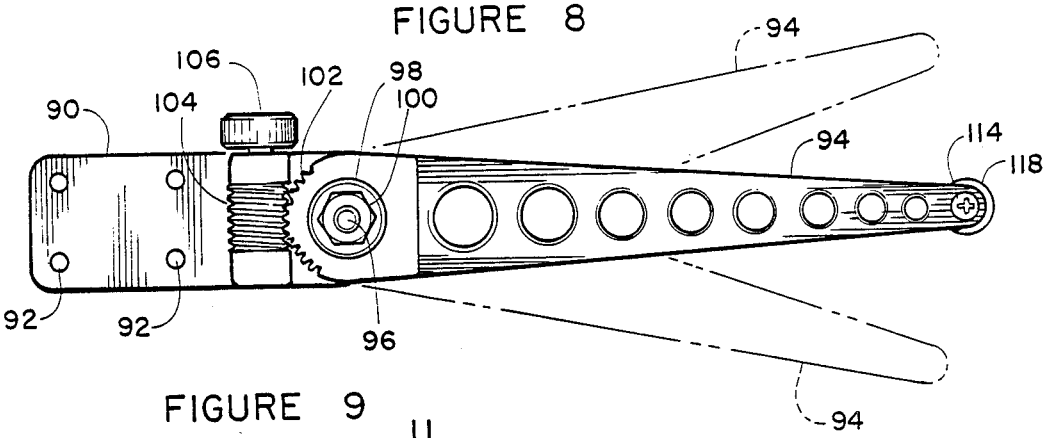
FIG. 9 is a side elevation view of my preferred sight.
Figure 10:
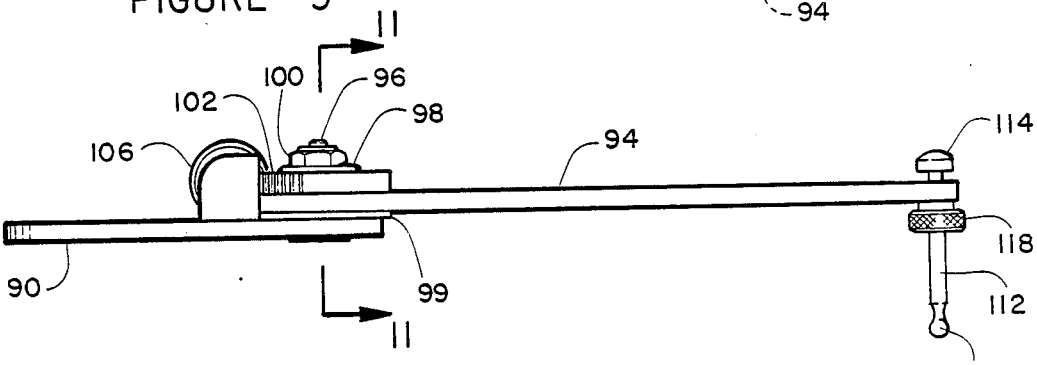
FIG. 10 is a plan view of the sight of FIG. 9 looking upwardly from below.
Figure 11:
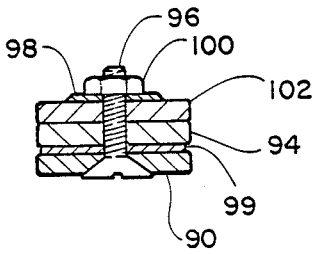
FIG. 11 is a detail sectional view showing the sight adjusting means, taken on line 11—11 in FIG. 10.

A sight assembly 88 is mounted on riser 10 at a convenient height above arrow 14 as seen in FIGS. 1 and 2. Details of sight assembly 88 are provided in FIGS. 9, 10 and 11.

Sight bracket 90 has holes 92 for bolting the assembly to riser 10. An elongated arm 94 extends forwardly of bracket 90 and is mounted on bracket 90 in a manner permitting pivoting about a stud 96 from the position shown in solid lines to the upper and lower positions shown in broken lines. A bushing 99 is positioned between bracket 90 and 94 to allow ease of relative positioning. A spring washer 98 is pressed against arm 94 by a nut 100 to hold the arm in a selected position. The inner end of arm 94 is configured as a gear segment 102 which engages a worm gear 104 rotatable by a knob 106 to raise or lower arm 94.

A thin bolt 112 is threaded through a hole near the free end of arm 94. The end of bolt 112 carries a small spherical bead 116 which is the actual sight that the archer lines up with a target. A locking nut 118 is provided to engage arm 94 to lock bolt 112 in a selected position against inadvertent movement.

In use, an archer adjusts the height of sight bead 116 by rotating knob 106 and the horizontal position of sight bead 116 by loosening locking nut 118, adjusting bolt 112 with a screwdriver engaging slots in the end 114 of bolt 112, then tightening locking bolt 118. As target range, wind conditions, etc. vary, this sight can be easily readjusted. While this novel sight is preferred for use with my bow, any other sight can be used, if desired.

A handgrip 120 is fastened to housing 48 by a bottom plate 122 and screws 124, as seen in FIG. 5. The handgrip is shaped and positioned to permit the archer to comfortably hold the bow and draw the bowstring.

An adjustable arrow rest assembly 126 is fastened to the upper end of handgrip 120 as seen in FIGS. 1 and 2. Assembly 126 includes a rod 12 which is positioned parallel to the arrow position (as seen in FIG. 1). The arrow rest is movable along rod 12 to conform to the length of the arrow being used, directly above handgrip 120 for normal arrows as seen in FIG. 1 and behind the handgrip for shorter, faster, arrows.

Figure 12:
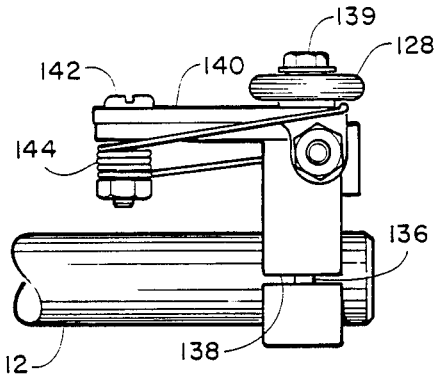
FIG. 12 is left side elevation view of my adjustable arrow rest means.
Figure 13:
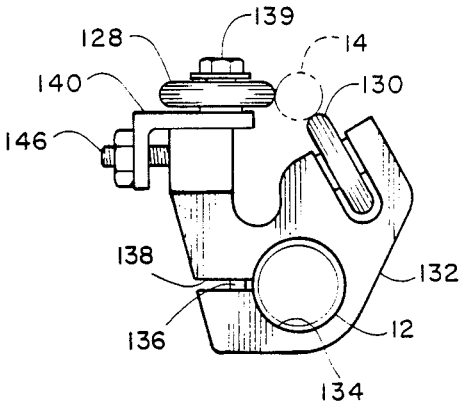
FIG. 13 is front elevation view of the arrow rest means of FIG. 12.
Figure 14:
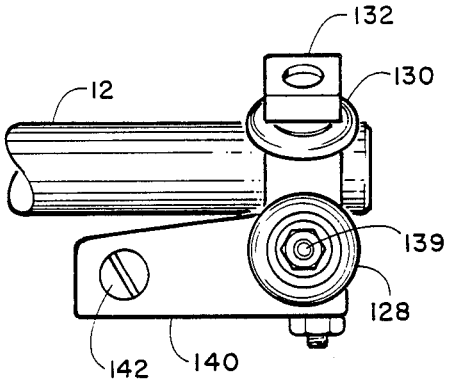
FIG. 14 is a plan view of the arrow rest means of FIG. 12.

Details of the adjustable arrow rest assembly are provided in FIGS. 12–14. Two arrow guide wheels are rotatably mounted in a manner which supports arrow 14 without interfering with arrow feathers. Wheel 130 is mounted directly on arrow rest bracket 132 which includes a slotted hole 134 adapted to fit over rod 12 and to be locked in place by tightening locking screw 136 extending upwardly in a hole in the bottom of bracket 132 which closes slot 138.

Wheel 128 is rotatably mounted on bolt 139 on a pivotable bracket 140 for pivoting about the axis of mounting bolt 142. A spring 144 is coiled about bolt 142 and has two extended ends which bias bracket 140 in a direction moving wheel 128 toward arrow 14. The desired position for wheel 128, depending upon the diameter of arrow 14, is set by setscrew 146 mounted in bracket 140 and bearing against bracket 132. Spring 144 serves to keep the end of setscrew 146 in contact with bracket 132 while allowing shock to be absorbed if pivotable bracket 140 is bumped by arrow 14 during release. Arrows flex as they move under power. Movable wheel 128 allows the flex without altering the course of flight.

Figure 15:
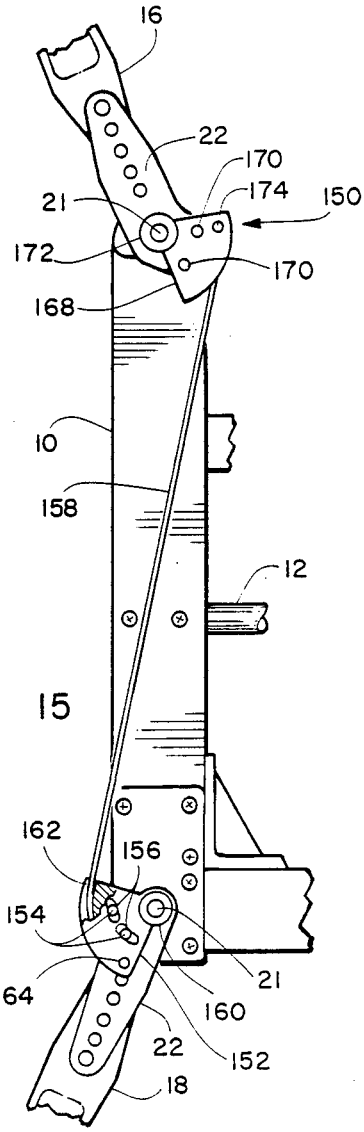
FIG. 15 is a right side elevation view of a portion of my bow, showing an alternate embodiment of the adjustable limb connection means.

An alternate embodiment of the adjustable limb connection means shown in FIG. 2 is illustrated in Figure 15. Riser 10, arrow rest rod 12, upper limb 16, lower limb 18, power links 22, etc. are all as seen in FIGS. 1 and 2, although power links 22 are shaped slightly differently. The connecting rod assembly 26 of FIGS. 1 and 2 is replaced by the cam-and-cable assembly 150 of this embodiment.

A lower cam 152 is fastened to power link 22 by a pair of bolts 154 which pass through holes 156 in cam 152 and into threaded holes in power link 22. Holes 156 are short arcuate slots along an arc drawn about the center of bolt 21. Thus, the position of cam 152 relative to power link 22 and the effective length of cable 158 is adjustable by tightening bolts 154 at selected points along arcuate holes 156. The inner surface of cam 152 rides against a raised boss 160 on power link 22 to assure that bolts 154 slide along the arcuate holes 156 during adjustment and to provide further support for cam 152.

As seen in the cut-away portion of cam 152, flexible cable 158 is entrained in a groove 162 in the cam surface and is fastened to cam 152 beyond the cam surface by a pin 164 secured to the cable end and positioned in a hole in the cam. Cam 152 can have any suitable cam surface configuration. Cable 158 preferrably is a stranded metal cable, although any other sturdy flexible material may be used, such as graphite or Kevlar aramid fibers, if desired.

Upper cam 168 is generally similar to cam 152. If further adjustability is desired, arcuate slot-like holes may be provided in cam 168 to receive fastening bolts 170. Otherwise, simple round holes may be used, leaving adjustment to cam 152. The inner surface of cam 168 rides against upraised boss 172 on upper power link 22. Cable 158 is secured to cam 168 by a pin 174 fastened to the cable end and lying in a hole in cam 168.

Thus, tiller may be adjusted by moving the mounting bolts of one or both cams to a selected position along arcuate slots in the cams and tightening the bolts.

While certain preferred configurations, arrangements and materials were described in the above description of preferred embodiments, these can be varied, where suitable, with similar results. For example different sights and arrow rests may be used and power sources other than a coil spring may be used, if desired. As detailed above, the lengths of the limbs and of any of the toggle links can be varied to vary the characteristics of the bow. For example a short link 66 makes for the quickest acceleration of the arrow, while a longer link produces a smoother drawing bow, but one of lesser speed. My bow provides adjustability of draw length, draw weight, hold weight, tiller and the arrow guide, making fine tuning of the bow simple. Changing power allows a hunter to practice with a lighter draw weight until hunting season, then extra power can be used with the until hunting season, then extra power can be used with the same bow, balance, weight and feel. The preferred embodiment of my invention as shown in the various Figures, uses a single toggle link, housing and power canister assemblies connected to the lower power link it should be understood, however, that a second single toggle link, housing and power canister assemblies could be connected to the upper power links in a similar manner on the opposite side of the riser 10. The use of upper and lower link housing and power canister assemblies would provide increased string pull and resulting increased arrow speed or could allow for smaller assemblies with the same string pull as expected from the assemblies connected to the lower power link only.

Other variations, applications and ramifications of this invention will occur to those skilled in the art upon reading this specification. Those are intended to be included within the scope of this invention, as defined in the appended claims.

I claim:

1. A toggle link compound bow which comprises:

an elongated riser;

a first limb pivotably connected to one end of said riser;

a second limb pivotably connected to the other end of said riser;

said pivotal connection between each limb and said riser comprises two links removably fastened to each limb at one end and pivotably fastened to said riser at the other end.

the free ends of said limbs adapted to having a bowstring fastened therebetween;

adjustable connecting means connected to said first and second limbs to cause said limbs to move in unison;

said limbs being movable from a first rest position with said bowstring substantially straight to a second full draw position with said bowstring bent away from said riser;

a toggle link assembly operatively connected to one of said limbs adjacent to said connection to said riser; and an energy storage means also operatively connected to said toggle link assembly;

whereby as said bowstring is moved to the full draw position, said limb and toggle link assembly causes energy to be strored in said energy storage means and to return that energy by forcefully moving said bowstring and limbs to the rest position when the bowstring is released.

2. The bow according to claim 1 wherein said adjustable connecting means comprises:

a forwardly extending extension on a power link at one limb and a rearwardly extending extension on a power link at the other limb;

an end fitting pivotably attached to each of said extensions;

a connecting rod extending between said end fittings and threaded into threaded holes in said end fittings; and the thread at one end of said connecting rod being a right hand thread and at the other being a left hand thread;

whereby the distance between said end fittings can be adjusted by rotating said connecting rod in one direction or the other.

3. The bow according to claim 1 where in said adjustable connecting means comprises:

a forwardly extending cam member secured to a power link at one limb;

a rearwardly extending cam member secured to a power link at the other limb;

a flexible cable extending between said cam members and entrained over the cam surfaces of said cam members;

said cable fastened to said cam members beyond said cam surfaces;

the means securing at least one of said cam members to the associated power link comprising at least one bolt extending through a slot in said cam member into said power link; and said slot being oriented in a direction substantially along an arc drawn about the pivot between said limb and riser;

whereby said bolt may be loosened, said cam member may be moved to move said slot along said bolt and the bolt retightened to effectively change the length of said cable relative to the positions of said power links.

4. The bow according to claim 1 wherein said toggle link assembly comprises:

a housing fastened to said riser;

a first toggle link within said housing rigidly but removably fastened to one of said limbs at the limb-to riser connection point, said link having an end extending away from said connection point in a direction substantially opposite to the direction of said limb;

a second toggle link within said housing having a first end pivotably connected to said extended end of said first toggle link and a second end pivotably connected to a first end of a piston rod; and said piston rod carrying at the other end a piston slidably housed in a canister operatively connected to said housing;

whereby as said limbs are moved from said rest position to said full draw position said first and second toggle links move from a bent position to a straighter position and pushes said piston into said canister.

5. The bow according to claim 4 further including a set-screw adjacent to one of said first and second toggle links against which said link moves when said bow is moved to the full draw position, whereby said set-screw can be adjusted to limit the full draw position of said link to a selected point, thereby limiting the hold weight of the bow to a desired extent and assuring that every draw of the bow in a sequence will be identical.

6. The bow according to claim 4 wherein said energy storage means includes a coil compression spring within said canister and which drives said piston outwardly of said canister when said bowstring is released.

7. The bow according to claim 6 further comprising a plug threaded into said canister to engage the end of said spring opposite to the end engaging said piston whereby the degree of pre-load on said spring can be adjusted by varying the distance said plug is threaded into said canister.

8. The bow according to claim 7 wherein said plug further includes a metal washer between the end of said spring and said plug and a low friction disk between said plug and said washer whereby said plug may be rotated easily despite considerable spring pressure thereagainst.

9. The bow according to claim 4 wherein said first toggle link and said limbs are adapted to being removed and replaced with links and limbs of different lengths to change the draw length of the bow.

10. The bow according to claim 4 wherein said second toggle link is adapted to being removed and replaced with a link of different configuration to vary arrow acceleration and smoothness of drawing the bow.

11. The bow according to claim 1 further including an arrow rest comprising:

a handgrip mounted on said housing;

a rod mounted on said handgrip extending substantially parallel to the desired arrow path;

a first rest bracket movable along said rod and selectively fastenable thereto;

a first guide wheel rotatably mounted on said first rest bracket in a position to partially support an arrow;

a movable bracket pivotably mounted on said first rest bracket and spring biased toward the position of an arrow on said rest;

a second guide wheel rotatably mounted on said movable bracket to support an arrow in cooperation with said first guide wheel; and a set-screw to selectively limit the distance toward said arrow said spring can move said movable bracket;

whereby said set-screw can be adjusted to accommodate arrows of different diameters between said guide wheels and said movable bracket can move in response to arrow flex as an arrow moves along said rest.

12. The bow according to claim 1 further including a sight assembly comprising:

a sight bracket mounted on said riser;

an elongated arm mounted on said bracket and extending generally in the direction of arrow flight from the bow;

a sight bead means secured to the free end of said arm;

the means mounting said arm on said bracket including gear-means for pivoting said arm in a substantially vertical plane to elevate and depress said sight bead; and transverse adjustment means between said sight bead and arm for adjusting the position of said bead relative to said arm.

13. The bow according to claim 12 wherein said transverse adjustment means comprises;

a threaded rod having said bead on one end, the free end of said arm having a threaded hole for receiving said rod;

means on the end of said rod opposite said bead adapted to receive means for rotating said rod to change the position of the bead relative to said arm; and means to releasably lock said rod in a selected position.

14. The bow according to claim 12 wherein said means for pivoting said arm comprises:

a pivot pin extending between arm and bracket about which said arm can pivot relative to said bracket;

a gear sector on said arm at least partially surrounding said pivot;

a worm gear mounted on said bracket in engagement with said gear sector; and means for rotating said worm gear;

whereby rotation of said worm gear raises and lowers the free end of said arm to a selected location.

15. The bow according to claim 1 further including low friction means for removably securing said bowstring to said limbs which comprises:

a slot in the free end of each limb, said slots lying in a single plane in which a bowstring strung therebetween also lies;

an axle extending through a hole in each limb substantially perpendicular to each slot;

a pulley rotatably mounted on each axle within each slot adapted to having a loop in an end of a bowstring placed therearound; and removable means on the ends of each axle holding said axles in position in each limb end;

whereby said bow may be easily restrung by removing and replacing said pulleys.

16. In a compound bow having an elongated riser, a pair of limbs pivotably connected to the ends of said riser, means interconnecting said limbs to cause them to move in unison, a bowstring interconnecting the free ends of said limbs and means to store energy as said bowstring is moved to a full draw postition and return it to said string upon release of said string, the improvement wherein said energy storage means comprises:

a first toggle link rigidly secured to one of said limbs and having an end extending beyond said limb;

a second toggle link having a first end pivotably attached to the extended end of said first link;

said toggle links in a housing having substantially rectangular cross-section and at least one wheel, sized to ride against opposite interior walls of said housing, is fastened to the pivotable connection between said second toggle links and said piston means to accomodate side loading on said piston means;

a piston means pivotably attached to the second end of said second link;

a power storage means arranged adjacent the free end of said piston means;

said toggle links being arranged so as to be bent when said limb is at rest and to be elongated and push said piston means against said energy storage means when said bowstring is drawn.

17. The improvement according to claim 16 further including a movable set-screw positioned to contact one of said toggle links to prevent further elongation of said link assembly as the bowstring is drawn whereby the position of the setscrew determines the hold weight of the bow and provides a positive draw stop assuring the same power to an arrow from shot to shot.

18. The improvement according to claim 16 wherein said energy storage means comprises a coil compression spring in a tubular canister whereby energy is stored by compression of the spring by the piston means during draw of the bowstring and released back to the bowstring when the bowstring is released.

19. The improvement according to claim 18 further includes a plug threaded into the canister end opposite said piston means whereby spring pre-load can be adjusted by rotating said plug to thread it against said spring into or out of said canister.

20. The improvement according to claim 19 further including a metal washer between said plug and said spring, in contact with said spring, and a low friction disk between said plug and said washer to reduce the force necessary in rotating said plug into or out of said canister.

21. The improvement according to claim 16 wherein the means securing said first and second toggle links to the other components are removable so that said links can be removed and replaced with other links of differing configurations to vary draw length and acceleration characteristics of the bow.

22. In a compound bow having an elongated riser, a pair of limbs pivotably connected to the ends of said riser, means interconnecting said limbs to cause them to move in unison, a bowstring interconnecting the free ends of said limbs and means to store energy as said bowstring is moved to a full draw position and return it to said string upon release of said string, the improvement wherein said means interconnecting said limbs comprises:

two power links each removably fastened to a limb at one end and pivotably fastened to said riser at the other end;

a forwardly extending extension on a power link at one limb and a rearwardly extending extension on a power link at the other limb;

an end fitting pivotably attached to each of said extensions;

a connecting rod extending between said end fittings and threaded into threaded holes in said end fittings; and the thread at one end of said connecting rod being a right hand thread and at the other being a left hand thread;

whereby the distance between said end fittings can be adjusted by rotating said connecting rod in one direction or the other.

23. In a compound bow having an elongated riser, a pair of limbs pivotably connected to the ends of said riser, means interconnecting said limbs to cause them to move in unison, a bowstring interconnecting the free ends of said limbs and means to store energy as said bowstring is moved to a full draw position and return it to said bowstring upon release of said bowstring, the improvement wherein said means interconnecting said limbs comprises:

two power links each removably fastened to a limb at one end and pivotably fastened to said riser at the other end;

a forwardly extending cam member secured to a power link at one limb;

a rearwardly extending cam member secured to a power link at the other limb;

a flexible cable extending between said cam members and entrained over the cam surfaces of said cam members;

said cable fastened to said cam members beyond said cam surfaces;

the means securing at least one of said cam members to the associated power link comprising at least one bolt extending through a slot in said cam member into said power link; and said slot being oriented in a direction substantially along an arc drawn about the pivot point between said limb and said riser;

whereby said bolt may be loosened, said cam member may be moved to move said slot along said bolt and the bolt retightened to effectively change the length of said cable relative to the positions of said power links.

24. In a compound bow having an elongated riser, a pair of limbs pivotably connected to the ends of said riser, means interconnecting said limbs to cause them to move in unison, a bowstring interconnecting the free ends of said limbs, arrow rest means and means to store energy as said bowstring is drawn and return it to said bowstring upon release of said bowstring, the improvement wherein said arrow rest means comprises:

a handgrip mounted on said housing;

a rod mounted on said handgrip extending substantially parallel to the desired arrow path;

a first rest bracket movable along said rod and selectively fastenable thereto;

a first guide wheel rotatably mounted on said first rest bracket in a position to partially support an arrow;

a movable bracket pivotably-mounted on said first rest bracket and spring biased toward the position of an arrow on said rest;

a second guide wheel rotatably mounted on said movable bracket to support an arrow in cooperation with said first guide wheel; and a set-screw to selectively limit the distance toward said arrow said spring can move said movable bracket;

whereby said set-screw can be adjusted to accommodate arrows of different diameters between said guide wheels and said movable bracket can move in response to arrow flex as an arrow moves along said rest.

25. A limb position adjustment means for a compound bow of the type having a central riser, a pair of limbs pivotably attached to the riser ends and interconnected to move in unison, and a bowstring extending between the free ends of said limbs, said adjustment means comprising:

two power links each removably fastened to a limb at one end and pivotably fastened to said riser at the other end;

a forwardly extending cam member secured to a power link at one limb;

a rearwardly extending cam member secured to a power link at the other limb;

a flexible cable extending between said cam members and entrained over the cam surfaces of said cam members;

said cable fastened to said cam members beyond said cam surfaces;

the means securing at least one of said cam members to the associated power link comprising at least one bolt extending through a slot in said cam member into said power link; and said slot being oriented in a direction substantially along an arc drawn about the pivot point between said limb and said riser;

whereby said bolt may be loosened, said cam member may be moved to move said slot along said bolt and the bolt retightened to effectively change the length of said cable relative to the positions of said power links.

26. A limb adjustment means for a compound bow of the type having a central riser, a pair of limbs pivotably attached to the riser ends and interconnected to move in unison and a bowstring extending between the free ends of said limbs, said adjustment means comprising:

two power links each removably fastened to a limb at one end and pivotably fastened to said riser at the other end;

a forwardly extending extension on a power link at one limb and a rearwardly extending extension on a power link at the other limb;

an end fitting pivotably attached to each of said extensions;

a connecting rod extending between said end fittings and threaded into threaded holes in said end fittings; and the thread at one end of said connecting rod being a right hand thread and at the other being a left hand thread;

whereby the distance between said end fittings can be adjusted by rotating said connecting rod in one direction or the other.

27. An energy storage means for a compound bow of the type having a central riser, a pair of limbs pivotally attached to the riser ends and a bowstring extending between the free ends of said limbs, said energy storage means storing energy as said bowstring is drawn and returning the energy to the bowstring when said bowstring is released, said storage means comprising:

a housing fastened to said riser;

a first toggle link within said housing rigidly but removably fastened to one of said limbs at the limb-to-riser connection point, said link having an end extending away from said connection point in a direction substantially opposite to the direction of said limb;

a second toggle link within said housing having first end pivotally connected to said extended end of said first toggle link and a second end pivotally connected to a first end of a piston rod;

said first toggle link and said limbs are adapted to be removed and replaced with a link and limbs of different lengths to change the draw length of the bow;

a set screw adjacent to one of said first and second toggle links against which said link moves when said bow is moved to the full draw position, whereby said set-screw can be adjusted to limit the full draw position of said link to a selected point, thereby limiting the hold weight of the bow to a desired extent and assuring that every draw of the bow in a sequence will be identical; and whereby as said limbs are moved from said rest position to said full draw position said first and second toggle links move from a bent position to a straighter position and pushes said piston into said housing.

28. The energy storage means according to claim 27 further including a coil compression spring within said housing and which drives said piston outwardly of said housing when said bowstring is released.

29. The energy storage means according to claim 27 further comprising a plug threaded into said housing engage the end of said spring opposite to the end engaging said piston whereby the degree of pre-load on said spring can be adjusted by varying the distance said plug is threaded into said housing.

30. The energy storage means according to claim 29 wherein said plug further includes a metal washer between the end of said spring and said plug and a low friction disk between said plug and said washer whereby said plug may be rotated easily despite considerable spring pressure thereagainst.

31. An arrow rest for an archer's bow which comprises:

a rod mounted on said bow adjacent to the position of an arrow at full draw;

said rod lying substantiaily parallel to the desired arrow path and having a length sufficient to overlap arrows of several lengths;

a first rest bracket movable along said rod and selectively fastenable thereto;

a first guide wheel rotatably mounted on said first rest bracket in a position to partially support an arrow;

a movable bracket pivotably mounted on said first rest bracket and spring biased toward the position of an arrow on said rest;

a second guide wheel rotatably mounted on said movable bracket to support an arrow in cooperation with said first guide wheel; and a set-screw to selectively limit the distance toward said arrow said spring can move said movable bracket;

whereby said set-screw can be adjusted to accommodate arrows of different diameters between said guide wheels and said movable bracket can move in response to arrow flex as an arrow moves along said rest.

32. An arrow rest for use with an archer's bow which comprises;

a housing;

a handgrip mounted on said housing;

a rod mounted on said handgrip extending substantially parallel to the desired arrow path;

a first rest bracket movable along said rod and selectively fastenable thereto;

a first guide wheel rotatably mounted on said first rest bracket in a position to partially support an arrow;

a movable bracket pivotably mounted on said first rest bracket and spring biased toward the position of an arrow on said rest;

a second guide wheel rotatably mounted on said movable bracket to support an arrow in cooperation with said first guide wheel; and a set-screw to selectively limit the distance toward said arrow said spring can move said movable bracket;

whereby said set-screw can be adjusted to accommodate arrows of different diameters between said guide wheels and said movable bracket can move in response to arrow flex as an arrow moves along said rest.

* * * * *